US005540242A

United States Patent [19]

Chao et al.

[11] Patent Number: 5,540,242

[45] Date of Patent: Jul. 30, 1996

[54] CIGARETTE PAPER HAVING REDUCED SIDESTREAM PROPERTIES

[75] Inventors: Li-Chung Chao; Jiunn-Yang Tang, both of Louisville; Frank K. St. Charles, Fisherville; Steven Houpt, Louisville, all of Ky.

[73] Assignee: Brown & Williamson Tobacco Corporation, Louisville, Ky.

[21] Appl. No.: 88,516

[22] Filed: Jul. 7, 1993

[51] Int. Cl.[6] ..... A42D 1/02

[52] U.S. Cl. ..... 131/365

[58] Field of Search ..... 131/365

[56] References Cited

U.S. PATENT DOCUMENTS

| | | | |
|---|---|---|---|
| 2,580,568 | 1/1952 | Matthews et al. . | |
| 2,580,608 | 1/1952 | Schur . | |
| 2,580,609 | 1/1952 | Schur . | |
| 2,580,610 | 1/1952 | Schur . | |
| 2,580,611 | 1/1952 | Schur . | |
| 2,652,835 | 9/1953 | Schur . | |
| 3,528,432 | 9/1970 | Stossel . | |
| 4,225,636 | 9/1980 | Cline et al. . | |
| 4,450,847 | 3/1984 | Owens . | |
| 4,461,311 | 7/1984 | Matthews et al. . | |
| 4,505,282 | 3/1985 | Cogbill et al. . | |
| 4,548,677 | 10/1985 | Scheider et al. . | |
| 4,564,031 | 1/1986 | Egri . | |
| 4,622,983 | 11/1986 | Mathews et al. | 131/365 |
| 4,730,628 | 3/1988 | Townsend et al. . | |
| 4,739,775 | 4/1988 | Hampl, Jr. . | |
| 4,756,319 | 7/1988 | Takanashi . | |
| 4,874,000 | 10/1989 | Tamol et al. | 131/375 |
| 4,938,238 | 7/1990 | Barnes et al. . | |
| 4,941,486 | 7/1990 | Dube et al. . | |
| 4,942,888 | 7/1990 | Montoya et al. | 131/365 X |
| 4,984,589 | 1/1991 | Riedesser | 131/365 |
| 5,092,353 | 3/1992 | Montoya et al. | 131/365 X |
| 5,131,416 | 7/1992 | Gentry | 131/365 |
| 5,261,425 | 11/1993 | Raker et al. | 131/365 |
| 5,271,419 | 12/1993 | Arzonico et al. | 131/365 |

OTHER PUBLICATIONS

"Industrial Games Polysaccharides and Their Derivatives" Whistler and BeMiller Academic Press, 1959.

*Primary Examiner*—Jennifer Bahr
*Attorney, Agent, or Firm*—Charles I. Sherman

[57] ABSTRACT

The present invention incorporates film forming additives to modify cigarette paper in such a fashion as to reduce sidestream smoke. The sidestream smoke reduction paper includes an alginate as a film forming agent used in combination with a burn additive to form a coating to reduce visible sidestream smoke as compared to a control paper without the additives. The alginates include ammonium alginate, sodium alginate, and potassium alginate. The preferred burn additives include alkali metal salts, particularly alkali metal carboxylates, which include potassium succinate, potassium citrate, potassium acetate, sodium succinate, sodium citrate, and sodium acetate, added to the cigarette paper in combination with the film forming agents. An acid may be used in combination with a burn additive to form a precoat solution applied to the cigarette wrapping paper preceding the addition of a film forming agent. Additional burn additives may be incorporated in the film forming agent after the precoat to coat the cigarette wrapping paper and further reduce the sidestream smoke. The sidestream smoke reducing paper of the present invention imparts good smoke quality without an off-taste, gives an increased puff count, and has good ash appearance.

9 Claims, No Drawings

CIGARETTE PAPER HAVING REDUCED SIDESTREAM PROPERTIES

BACKGROUND OF THE INVENTION

This invention relates to smoking articles and more particularly to a cigarette wrapper for a smoking article and even more particularly to a cigarette wrapper for smoking articles having reduced sidestream smoke properties.

Sidestream smoke in the cigarette industry is recognized as the smoke given off by the burning of a cigarette or other smoking article during the burning of the smoking article between puffs by the smoker. The smoke that the smoker takes in during the puffing process is recognized as the mainstream smoke. The sidestream smoke therefore, is the smoke which directly enters the atmosphere during the static burn period of a cigarette. There has been a substantial amount of work in the prior art on cigarette wrappers for the reduction of this sidestream smoke. Two recent patents that issued in this area are U.S. Pat. No. 4,998,541 to Perfetti et al and U.S. Pat. No. 4,998,543 to Goodman et al. The Perfetti reference teaches the use of magnesium hydroxide, calcium carbonate, and flax in a paper wrapper and Goodman teaches a double wrapped tobacco product wherein one paper layer includes calcium carbonate and a burn control chemical and the other layer, or second paper wrapper, includes monoammonium phosphate and sodium carboxymethyl cellulose.

To date, none of the commercially available low sidestream papers have been used to produce cigarettes which are entirely satisfactory. Unacceptable characteristics include having a chalky off-taste, a mouth coating, a flaky ash, a mottled ash appearance, or a reduced puff count.

SUMMARY OF THE INVENTION

It is an object of the present invention to provide a cigarette paper having reduced sidestream smoke deliveries. It is another object of this invention to provide a cigarette paper composition using film forming agents applied thereto to reduce sidestream smoke delivery. It is still another object of this invention to provide a cigarette paper for having reduced sidestream smoke deliveries of a specific basis weight paper and a specific selected porosity in combination with film forming agents and burn additives.

The present invention incorporates additives to modify cigarette paper in such a fashion as to reduce sidestream smoke. The sidestream smoke reduction means includes an alginate film forming agent, such as ammonium alginate and a burn additive, such as potassium succinate and/or potassium citrate, or an alkali carboxylate added to cigarette paper to reduce the sidestream smoke when compared with a control paper without additives. The sidestream reducing means incorporated in the present invention imparts a good smoke quality without an off-taste, gives an increased puff count, and has good ash appearance. In general, the use of about 0.3 to 4 percent by weight of ammonium alginate and 1 to 8 percent by weight of a potassium carboxylate on a cigarette paper can reduce sidestream smoke as compared to conventional paper.

More particularly, the present invention is directed to a cigarette wrapping paper having a basis weight of from about 20 to about 65 grams per square meter and an initial porosity of from about 5 to about 50 Coresta units, said paper comprising from about 0.3 to about 4.0 parts by weight of a film forming agent and from about 1 to about 8 parts by weight of a burn additive for every 100 parts by weight of wrapping paper.

Other objects and advantages of this invention will become apparent to those skilled in the art upon consideration of the accompanying disclosure.

DETAILED DESCRIPTION OF THE PREFERRED EMBODIMENT

The present invention resides in the recognition that certain film forming agents and burn additives may be added to selected basis weight cigarette papers having a selected initial porosity range wherein the combination when used with a tobacco rod reduces the sidestream smoke capabilities without imparting unfavorable taste characteristics or reducing puff count. For example, the cigarette wrapping paper of the present invention has a basis weight of from about 20 to about 65 grams per square meter, an initial porosity of from about 5 to about 50 Coresta units, and includes selected film forming agents and burn additives which reduce the sidestream smoke deliveries of smoking articles.

Specifically, it has been found that preferred film forming agents utilized in the present invention include alginates such as ammonium alginate, sodium alginate and potassium alginate. It has been found that the concentration of the film forming agent in the cigarette wrapping paper is preferably in the range of from about 0.3 to about 4.0 parts by weight for every 100 parts by weight of wrapping paper.

In the inclusion of burn additives in the cigarette wrapping paper, the preferred burn additives have been found to be those which are selected from alkali metal salts such as potassium succinate, potassium citrate, potassium acetate and sodium acetate. Moreover, the concentration of the burn additive in the cigarette wrapper paper is preferably in a range of from about 1.0 to about 8.0 parts by weight per 100 parts by weight of wrapping paper.

It is also been found that other additives may be utilized in combination with the film forming agents and burn additives which are also desirable in lowering the sidestream smoke deliveries in the present invention. These include, for example, malto dextrin, corn syrup, and the like. The concentration of these additives to the cigarette wrapper paper are preferably in the range of from about 1 to about 8 parts by per 100 parts by weight of wrapping paper.

In the incorporation of these additives to the cigarette wrapper paper, one preferred method is to first prepare an appropriate solution including the film forming agents and burn additives. Once the solution is prepared, the solution can then be applied to the cigarette wrapper paper by several methods for coating cigarette wrapper paper including, but not limited to, the use of a brush, a size press, a gravure printer, or a blade coating process.

In the brushing process or method, the solution is applied to the paper by brushing the solution onto the cigarette wrapper paper. For example, using the brushing method, application of ammonium alginate and potassium carboxylates on a heavy basis weight cigarette paper reduced the sidestream smoke of cigarettes produced with paper coated by about 50 percent compared to a control paper excluding the coating.

Another method of application utilized a pilot plant scale size press to apply various film forming solutions to the wrapping paper at different rates of speed adding approximately 3.5 percent by weight solids on the wrapping paper, thereby reducing the paper permeability from about 8–9 Coresta units to approximately 3 Coresta units. The coating solutions contained various percentages of an alginate used in combination with burn additives such as potassium succinate, potassium citrate and combinations thereof.

A pilot plant scale size gravure printer was also used as an alternate means to apply various film forming solutions to the cigarette wrapping paper by overprinting either the wire or felt side of the base paper using solutions containing various percentages of alginates, such as ammonium alginate, used in combination with burn additives such as potassium succinate, potassium citrate and combinations thereof. The gravure printer process reduced the paper permeability to 3–4 Coresta units after one coating on either side (felt or wire), and overprinting the felt side of the base paper twice on the gravure printer further reduced to 0–1 Coresta units. The sidestream tar levels of cigarettes produced using the coated paper were reduced from 24 mg to 10.8 mg and up to 55 percent reduction in sidestream smoke was achieved. (The method for measuring sidestream smoke components is set forth in U.S. Pat. No. 5,107,865).

Furthermore, a blade coating process provided a means of using a higher viscosity and higher solid content solution to coat the paper with a smooth, continuous, and uniform film coating. Application of solutions containing about 6 percent by weight alginate and about 7 percent by weight burn additives added about 3.0 percent by weight solids on the wrapping paper, thereby reducing the paper permeability of from about 6 to about 1–2 coresta units after one coating on either side (felt or wire). The sidestream smoke levels of cigarettes produced using the coated paper reduced sidestream tar to from about 10.5 to about 16.3 mg and achieved of from about a 33 percent to a 57 percent reduction in sidestream smoke.

A more comprehensive understanding of the invention can be obtained by considering the following examples. However, it should be understood that the examples are not intended to be unduly limitative of the invention.

EXAMPLE I

A printing process was developed to produce a good low sidestream smoke paper by the following processes as described in Methods (A–F) and Tables (IA)–(IF).

Method A

A cigarette wrapping paper was printed with a solution of additives of the present invention, wherein a base paper was passed through a size press. The printing equipment used to perform the experiments was a pilot scale 4" wide laboratory size press with felted dryers. The base wrapping paper used in the experiments was 4" wide, having a 45 g/m$^2$ basis weight, a 28 percent by weight chalk content, and 8–9 Coresta units of permeability.

The size press was at a machine speed of 15 rpm which produced a thick coating of material. The coating solution used with the size press contained 1.5 percent by weight ammonium alginate and 3.0 percent by weight potassium succinate. Application of the coating solution to the wrapping paper using the size press added approximately 3.5 percent by weight solids on the wrapping paper, thereby reducing the paper permeability from 8–9 Coresta units to approximately 3 Coresta units.

The size press experiment was repeated using machine speeds which varied from 15 to 35 rpm and using coating solutions containing various percentages of ammonium alginate and potassium succinate; ammonium alginate and potassium citrate; and ammonium alginate, potassium succinate, and potassium citrate as set forth in Table (IA).

TABLE (IA)

METHOD A (SIZE PRESS PROCESS)

| EXP # | SOLUTION | % ADDITION | POROSITY[d] (CORESTA) | SIDESTREAM[e] REDUCTION |
|---|---|---|---|---|
| 1 | 2% A 4% KS[a, b] | 3.9 | 3 | |
| 2 | 1.5% A 3% KS | 2.3 | 3 | |
| 3 | #1 paper coated on wire side w/1.5% A 3% KS | | 1 | Good |
| 4 | #1 paper coated on wire side w/1.5% A 3% KS (twice) | | 1 | Good |
| 5 | 2% A 2% C 2% S[c] | 6.4 | 5 | |
| 6 | #5 coated on wire side w/1.5% A 3% KS | | 3 | |
| 7 | #5 coated twice on wire side w/1.5% A 3% KS | | 1 | Good |

Table I Legend
[a]"A" is Ammonium Alginate, a food grade Amoloid LV obtained from Kelco;
[b]"S" or "KS" is potassium succinate prepared by reacting succinic acid with potassium hydroxide;
[c]"C" or "KC" is potassium citrate was obtained from Malinckrodt; and
[d]Base Paper: 45 g/m$^2$, 8–9 Corests units, 28% chalk.
[e]Sidestream reduction was based on visual observation.

Method B

A cigarette wrapping paper was printed with a solution of additives of the present invention, wherein a base paper was passed through a gravure printer. The printing equipment used to perform the experiments was a lab scale gravure printer more particularly, a Geiger Proof Press. The base wrapping paper used was 4" wide, having a 45 g/m$^2$ basis weight, a 28 percent by weight chalk content, and 8–9 Coresta units of permeability.

The coating solution comprising 1.5–2.0 percent by weight ammonium alginate and 3–4 percent by weight potassium succinate was applied to the gravure printer by overprinting either the wire or felt side of the base paper. The paper permeability was reduced to 3–4 Coresta units after one coating on either side (felt or wire). Overprinting the felt side of the base paper twice on the gravure printer produced the best results. The paper was further reduced to 0–1 Coresta units after two coatings as set forth in Table IB.

The cigarettes made using paper wrapping coated with the 2 percent by weight ammonium alginate and 4 percent by weight potassium succinate using the gravure printer generated 10.8 mg of total sidestream tar and achieved up to a 55 percent reduction in side stream smoke.

The gravure printer experiment was repeated using coating solutions containing various percentages of ammonium alginate and potassium succinate; ammonium alginate and potassium citrate; and ammonium alginate, potassium succinate, and potassium citrate as set forth in Table (IB).

TABLE (IB)

| | SOLUTION | PAPER SIDE | # OF COAT | % by Weight ADDITION | POROSITY (CORESTA) | SIDE-STREAM REDUCTION | SELF-EXINGUISHNG |
|---|---|---|---|---|---|---|---|
| | METHOD B (GRAVURE PRINTING) | | | | | | |
| 1 | 1.5% A 3.0% KS | F (Felt) | 1× | 3.5 | 3 | Moderate | NO |
| 2 | 1.5% A 3.0% KS | W (Wire) | 1× | 3.5 | 4 | M | N |
| 3 | 1.5% A 3.0% KS | F | 2× | 5.1 | 2 | Good | YES |
| 4 | 1.5% A 3.0% KS | W | 2× | 4.9 | 2 | G | Y |
| 5 | 2% A 2% C 2% S | F | 2× | 5.9 | 2 | M–G | N |
| 6 | 2% A 2% C 2% S | W | 2× | 4.9 | 2 | G | N |
| 7 | 2% A 2% C 2% S | F | 1× | 3.9 | 7 | M | N |
| 8 | 2% A 2% C 2% S | W | 1× | 3.8 | 4 | M | N |
| 9 | 1.5% A3.0% S | F, W | Ixeach | 5.1 | 1 | G | N |
| 10 | 6.5% K Acetate/ 1.5% A 3.0% S | F | 2× | — | — | M | N (dark-ash) |
| 11 | 2% A 4% S | F | 4× | — | 0 | Excellent | Y |
| 12* | 2% A 4% S | F | 2× | 7.4 | 0 | E | Y |

TABLE IB Legend
[a]"A" is Ammonium Alginate, a food grade "Amoloid LV" obtained from Kelco;
[b]"S" or "KS" is potassium succinate prepared by reacting succinic acid with potassium hydroxide;
[c]"C" or "KC" is potassium citrate was obtained from Mallinckrodt;
[d]"K Acetate" is potassium acetate;
[e]Base Paper: 45 g/M$^2$, 8–9 Coresta units, 28% chalk; and
*Sidestream tar-10.8 mg/cig., 0.6 mg/min., measured at Ecusta a division of P.H. Glatfelter Co.

Method C

A cigarette wrapping paper was printed with a solution of additives of the present invention, wherein a base paper was sequentially passed through a size press and then through a gravure printer. The printing equipment used to perform the experiments was a pilot scale size 4" wide lab size press, and a lab scale Geiger Proof Gravure Printer. The base wrapping paper used in the experiment was 4" wide, having a 45 g/m$^2$ basis weight, a 28 percent by weight chalk content, and 8–9 Coresta units of permeability.

A coating solution comprising 2 percent by total weight of ammonium alginate and 4 percent by total weight of potassium succinate was applied to the wrapping paper by overprinting either the wire or felt side of the base wrapping paper using the size press. The paper permeability was reduced by 3–4 Coresta units after one coating on either side (felt or wire). An additional layer of the same solution was then applied using the gravure printer. The paper was further reduced to 0–1 Coresta units after two coatings as set forth in Table (IC).

TABLE (IC)

| EXP # | SOLUTION | % ADDITION | POROSITY (CORESTA) |
|---|---|---|---|
| METHOD C (COMBINATION SIZE PRESS & GRAVURE PRINTING PROCESS) | | | |
| 1 | 2% A 4% KS | 7.6 | 2 |

[a]"A" is Ammonium Alginate, a feed grade Superloid Amoloid LV obtained from Kelco;
[b]S" or "KS" is potassium succinate prepared by reacting succinic acid with potassium hydroxide; and
[c]Base Paper: 45 g/m$^2$, 8–9 Coresta units, 28% chalk.

Method D

In this example, a cigarette wrapping paper was printed with a solution of additives of the present invention, wherein a base paper was passed through a blade coater. The printing equipment used to perform the experiments was a semi-commercial scale blade coater, more particularly a Jagen Berg Combination Coater. The base wrapping paper used in the experiments was four inches wide, having a basis weight of 44 g/m$^2$, 30 percent by weight chalk content, and about a 6 Coresta unit permeability.

The cigarette wrapping paper was coated on the blade coater on either wire side or felt side which produced a continuous uniform film of material. The coating solution used with the blade coating contained 6 percent by weight ammonium alginate, and 7.2 percent by weight potassium citrate. Application of the coating solution to the wrapping paper using the blade coating press added 2.9 percent by weight solids on the wrapping paper, thereby reducing the paper permeability from about 6 Coresta units to about 0 to 2 Coresta units.

The cigarettes made using paper wrapping coated with 6 percent by weight ammonium alginate and 7.2 percent by weight potassium citrate using the blade coating method generated between 10.5 and 10.7 mg of total sidestream tar and achieved 56 to 57 percent reduction in sidestream smoke for the wire side coating. The cigarettes made using paper wrapping coated with 6 percent by weight ammonium alginate and 7.2 percent by weight potassium citrate using the blade coating method generated from 14.8 to about 16.3 mg of total sidestream tar and achieved from 33 to about 39 percent reduction in sidestream smoke for the felt side coating as set forth in Table ID.

TABLE (ID)

| | BASE PAPER | | | METHOD D (BLADE COATING PROCESS) | | | | | |
|---|---|---|---|---|---|---|---|---|---|
| EXP # | BASE WT | % CHALK | INITIAL POROSITY CORESTA | SOLUTION | PAPER SIDE | # OF COAT | SOLIDS % ADDITION | SIDE-STREAM "TAR" (mg) | % SIDE-STREAM REDUCTION |
| 1A | 45 g/m$^2$, | 28% Chalk | 8–9 | 3.6 A, 7.2% KC | Wireside | 2× | 4.6 | 11.6[c] | 49 |
| 1B | 45 g/m$^2$, | 21% Chalk | 5 | 3.6 A, 7.2% KC | Wireside | 2× | 4.6 | 13.3[c] | 41 |
| 2 | 45 g/m$^2$, | 21% Chalk | 5 | 3.6 A, 7.2% KC | Feltside | 1× | 2.0 | 18.4–19.7[d] | 27–32 |
| 3A | 45 g/m$^2$, | 30% Chalk | 6 | 6.0 A, 7.2% KC | Wireside | 1× | 2.9 | 10.5–10.7[c] | 56–57 |
| 3B | 45 g/m$^2$, | 30% Chalk | 6 | 6.0 A, 7.2% KC | Feltside | 1× | 2.9 | 14.8–16.3[c] | 33–39 |

[a]"A" is Ammonium Alginate, a food grade Amoloid LV obtained from Kelco;
[b]"C" or "KC" is potassium citrate was obtained from Mallinckrodt;
[c]Control Sidestream Tar 24.1 mg/cig.
[d]Control Sidestream Tar 26.9 mg/cig.

Method E

Cigarette wrapping paper was precoated with a solution containing a burn additive and an acid in about a 3 to 1 ratio, and brush coated with a solution of film forming additives of the present invention.

Moreover, the precoat solution of the professional embodiment contained from 1.5 percent to 2.5 percent by weight potassium citrate, in combination with 0.5 percent to 1.0 percent by weight sulfuric acid. The coating solution used with the brush coating contained from 1 percent to 2 percent by weight ammonium alginate, and from 0.5 percent to 2 percent by weight potassium citrate. Application of the coating solution to the wrapping paper using the brush coating added from 3 percent to 5 percent by weight solids on the wrapping paper, thereby reducing the paper permeability of from about 6 Coresta units to about 2 Coresta units.

The cigarettes made using paper wrapping precoated with potassium citrate, sulfuric acid, and then coated with ammonium alginate achieved over a 50 percent reduction in sidestream smoke as set forth in Table (IE).

Method F

Conventional cigarette wrapping paper having a basis weight of about 25 g/m$^2$, and from 25 percent to 30 percent by weight chalk, and a porosity of from 46 to 10 Coresta units was brush coated with a solution of additives of the present invention.

The coating solution used with the brush coating contained 2 percent by weight ammonium alginate and 4 percent by weight potassium citrate. Application of the coating solution to the wrapping paper using the brush coating added from 3 percent to 8 percent by weight solids on the wrapping paper, thereby reducing the paper permeability to from 1.5 Coresta units to 3.6 Coresta units.

The cigarettes made using paper wrapping brush coated with the potassium citrate and ammonium alginate achieved from 25 percent to 35 percent reduction in sidestream smoke as set forth in Table (IF).

TABLE (IE)

| | METHOD E (PRECOAT/BRUSH COAT) | | | |
|---|---|---|---|---|
| EXP # | PRECOAT SOLUTION | FILM FORMING SOLUTION | SOLIDS % ADDITION | % SIDE-STREAM REDUCTION |
| 1 | 1.6% KC | 1.2% A, 0.8% KC | 3.6 | 32 |
| 2 | 2.4% KC | 1.2% A, | 3.6 | 43 |
| 3 | 1.6% KC | 1.5% A, 1.4% KC | 4.5 | 36 |
| 4 | 2.4% KC | 1.5% A, 0.6% KC | 4.5 | 42 |
| 5 | 1.6% KC | 1.7% A, 1.8% KC | 5.0 | 40 |
| 6 | 2.4% KC | 1.7% A, 1.0% KC | 5.0 | 38 |
| 7 | 1.6% KC,0.53 $H_2SO_4$ | 1.2% A, 0.8% KC | 3.6 | 49 |
| 8 | 2.4% KC, 0.80 $H_2SO_4$ | 1.2% A, | 3.6 | 52 |
| 9 | 1.6% KC, 0.53 $H_2SO_4$ | 1.5% A, 1.4% KC | 4.5 | 53 |
| 10 | 2.4% KC, 0.80 $H_2SO_4$ | 1.5% A, 0.6% KC | 4.5 | 52 |
| 11 | 1.6% KC, 0.53 $H_2SO_4$ | 1.7% A, 1.8% KC | 5.0 | 54 |
| 12 | 2.4% KC, 0.80 $H_2SO_4$ | 1.7% A, 1.0% KC | 5.0 | 46 |
| 13** | — | — | — | — |

**Control Sidestream Tar 24.1 mg/cig.
[a]"A" is Ammonium Alginate, a food grade Amoloid LV obtained Kelco;
[b]"KC" is potassium citrate was obtained from Malinckrodt; and
[c]$H_2SO_4$ is sulfuric acid.
[d]Base paper is 45 g/m$^2$ with 28% chalk and 8–9 Coresta and was coated on the wireside with one coating.

TABLE (IF)

| METHOD F (BRUSH COATING FOR NORMAL CIGARETTE PAPER) | | | | |
|---|---|---|---|---|
| SAMPLE # | BASE PAPER | % ADD ON | FINAL POROSITY | % REDUCTION IN SIDESTREAM |
| 1 | 46 Coresta, 25% Chalk | 7.7 | 1.5 | 29% |
| 2 | 10 Coresta, 29% Chalk | 5.6 | 1.8 | 32% |
| 3 | 15 Coresta, 29 % Chalk | 4.8 | 3.6 | 26% |

[a]Base paper is 25 g/m$^2$ paper.
[b]Coating solution is 2% Amoloid LV and 4% potassium citrate solution.

EXAMPLE II

In this example, a film forming solution was coated onto the base paper used for the cigarette wrapping paper. Various film forming agents including sodium carboxymethyl cellulose, ammonium alginate, combinations of sodium carboxymethyl cellulose and potassium succinate, and combinations of ammonium alginate and potassium succinate were used to correlate sidestream reduction with viscosity and permeability.

The cigarette spills used for coating were prepared from chemical free paper having a basis weight of about 47 g/m$^2$, a filler content of about 28 percent by weight chalk, and a porosity of about 5 to 6 Coresta units. The total length of the cigarettes was 99 mm wherein the tobacco section was 69 mm in length and the tipping was 36 mm in length. The circumference of the cigarettes was 24.7 mm.

The procedure that was followed in preparing additive solutions for use on a cigarette wrapper paper and then utilizing the cigarette wrapper paper including the additives in a smoking article was as follows.

Coating materials consisting of sodium carboxymethyl cellulose; ammonium alginate; potassium succinate; and potassium citrate were prepared. The viscosity of the coating solution was measured prior to applying to the cigarette spills. The amount on the cigarette spills was determined by weighing the spill before and after applying the solution. Approximately 100 mg of solution was hand painted on each cigarette spill. The amount of add-on was controlled by the concentration of solution instead of the amount of solution applied. The coated spills were air-dried and conditioned at 60 percent RH and 75° F. Approximately 630 mg of tobacco was blown into the spills.

As shown in Table II, samples 1–6 compare an equal weight of high viscosity grade sodium carboxymethyl cellulose and ammonium alginate without a burn additive. The cigarettes made with ammonium alginate coated paper at 1 percent and 1.5 percent add-on self extinguished. Samples 7–12 compare an equal weight of sodium carboxymethyl cellulose and ammonium alginate with 6 percent by weight potassium succinate as a burn additive. Sidestream reduction is greater with the ammonium alginate coated paper than with the sodium carboxymethyl cellulose coated paper while solution viscosities are much lower. Samples 13–18 were prepared to have an equal viscosity basis as the ammonium alginate solutions. When viscosities were comparable, the sidestream reduction with the ammonium alginate coated paper was much better than the sodium carboxymethyl cellulose coated paper. Samples 19–24 were prepared using low viscosity grade sodium carboxymethyl cellulose on an equal weight and near equal viscosity basis as compared with the ammonium alginate solutions. Both the ammonium alginate and high viscosity sodium carboxymethyl cellulose reduced paper permeability and sidestream smoke better than the low viscosity sodium carboxymethyl cellulose.

TABLE 11

| Sample | Sample Description[c] | Viscosity[c] (Spindle #) | Paper Permeability (Coresta) | Puff | SS Tar (mg) | % SS Reduction |
|---|---|---|---|---|---|---|
| | Control | | 5.6 | 9.2 | 24.1 | — |
| 1. | CMC9H4F(0.5 %) | 277 (4) | 3.3 | 12.0 | 18.9 | 22 |
| 2. | CMC9H4F(1.0%) | 1,231 (4) | 2.9 | 13.8 | 16.3 | 32 |
| 3. | CMC9H4F(1.5%) | 4,080 (6) | 1.9 | 15.7 | 13.8 | 32 |
| 4. | $NH_4$Alginate (0.5%)$_a$ | 61 (4) | 1.8 | 17.0 | 15.4 | 36 |
| 5. | $NH_4$Alginate (1.0%) | 157 (4) | 0.9 | 22.7[d] | 4.4 | 82 |
| 6. | $NH_4$Alginate (1.5%) | 733 (4) | 1.1 | 23.0[d] | 2.6 | 89 |
| 7. | CMC9H4F(0.5 %)/KS(6.0 %)[b] | 1,930 (4) | 3.4 | 9.3 | 15.3 | 37 |
| 8. | CMC9H4F(1.0%)/KS(6.0%)[b] | 3,405 (4) | 1.8 | 10.3 | 13.5 | 44 |
| 9. | CMC9H4F(1.5%)/KS(6.0%)$_b$ | 22,900 (6) | 1.2 | 12.2 | 12.5 | 48 |
| 10. | $NH_4$ALGINATE(0.5%)/KS(6.0%) | 43 (2) | 1.0 | 10.8 | 12.9 | 46 |
| 11. | $NH_4$ALGINATE(1.0%)/KS(6.0%) | 112 (2) | 1.7 | 11.3 | 11.9 | 51 |
| 12. | $NH_4$ALGINATE(1.5%)/KS(6.0%) | 584 (3) | 1.4 | 12.0 | 11.2 | 54 |
| 13. | CMC9H4F(0.11%) | 64 (2) | 6.1 | 11.5 | 23.0 | 5 |
| 14. | CMC9H4F(0.36%) | 154 (2) | 5.3 | 11.7 | 21.1 | 12 |
| 15. | CMC9H4F(0.88%) | 776 (4) | 3.1 | 13.0 | 18.5 | 23 |
| 16. | CMC9H4F(0.17%)/KS(6.0%) | 40 (2) | 4.6 | 9.4 | 17.8 | 26 |
| 17. | CMC9H4F(0.43%)/KS(6.0%) | 110 (2) | 4.0 | 8.9 | 16.2 | 33 |
| 18. | CMC9H4F(0.72%)/KS(6.0%) | 583 (3) | 3.0 | 9.0 | 15.1 | 37 |
| 19. | CMC12M31(0.5%) | 60 (2) | 5.3 | 10.7 | 23.2 | 4 |
| 20. | CMC12M31(1.0%) | 105 (2) | 5.3 | 10.9 | 22.2 | 8 |
| 21. | CMC12M31(1.5%) | 190 (2) | 4.6 | 11.7 | 18.4 | 24 |
| 22. | CMC12M31(0.5%/KS(6.0%) | 33 (2) | 4.6 | 8.4 | 16.3 | 32 |

TABLE 11-continued

| Sample | Sample Description[c] | Viscosity[e] (Spindle #) | Paper Permeability (Coresta) | Puff | SS Tar (mg) | % SS Reduction |
|---|---|---|---|---|---|---|
| 23. | CMC12M31(1.0%)/KS(6.0%) | 67 (2) | 3.9 | 9.5 | 16.4 | 32 |
| 24. | CMC12M31(1.5 %)/KS(6.0%) | 126 (2) | 3.4 | 10.0 | 16.1 | 32 |

[a]$NH_4$ Alginate is an industrial grade Superloid obtained from Kelco
CMC9H4F is sodium carboxymethyl cellulose with high viscosity obtained from Hercules Incorporated.
CMC12M31 is a low viscosity sodium carboxymethyl cellulose obtained from Hercules Incorporated.
[b]KS is potassium succinate.
[c]Approximately 100 mg of solution was applied.
[d]Cigarettes self-extinguished and were relit.
[e]Brookfield viscosity was measured at 100 RPM with spindle # listed in parenthesis at room temperature except for samples 7, 8, and 9, wherein the RPM was 20, 50, and 20, respectively.

In all of the samples, the low viscosity ammonium alginate solution performed as well or better than the higher viscosity sodium carboxymethyl cellulose solutions to produce lower sidestream smoke. A much higher viscosity sodium carboxymethyl cellulose solution had to be used to achieve approximately the same reduction in sidestream smoke. The higher viscosity sodium carboxymethyl cellulose solution was found to be more difficult to apply to the cigarette paper than the low viscosity ammonium alginate solution using conventional application methods, and required more sodium carboxymethyl cellulose substrate. Moreover, the ammonium alginate samples with the burn additive achieved a greater sidestream smoke reduction for a given permeability.

It is believed that the performance of the ammonium alginate solution is due to a synergistic interaction of the alginate and the $CaCO_3$ in the paper. A test was performed which indicated that there is a synergistic interaction between $CaCO_3$ (powdered chalk) and alginate, but not between sodium carboxymethyl cellulose (CMC) and $CaCO_3$. Solutions containing sodium carboxymethyl cellulose in water, and ammonium alginate in water were prepared having equal viscosity. Powdered chalk, $CaCO_3$, which has a low solubility in water, was sprinkled and stirred into the solution of sodium carboxymethyl cellulose in water, and into the solution of ammonium alginate in water. The chalk particles settled out of the sodium carboxymethyl cellulose solution, but remained suspended in the alginate solution. Eventually the beaker of alginate solution formed a complete gel.

The synergistic interaction of the alginate with the $CaCO_3$ contained in the cigarette wrapping is believed to be due to the chalk's divalent ions such as $Ca^{++}$ which react with the alginate to cross link and gel. Even though the ammonium alginate solution has a much lower viscosity in the pot, it behaves like a much higher viscosity solution when applied to the paper containing $CaCO_3$. These results show that the ammonium alginate is a better film forming agent on cigarette wrapping paper than sodium carboxymethyl cellulose.

EXAMPLE III

Cigarette spills were prepared from chemical free paper having a basis weight of about 47 g/m$^2$, a filler content of about 28 percent chalk, and porosity of 5 to 6 Coresta units. The total length of the cigarette was 99 mm wherein the tobacco section was 69 mm in length and the tipping was 36 mm in length. The circumference of the cigarettes was 24.7 mm.

Coating materials included ammonium alginate; sodium alginate; potassium alginate; industrial grade ammonium alginate; and, Maltrin M-250 and M-365 corn syrups having a dextrose equivalent of 25 and 37, respectively. Burn additives included potassium succinate; potassium citrate; and sodium citrate.

Solutions were prepared combining an alginate with at least one burn additive. Solutions were also prepared which included an alginate, a burn additive and corn syrup. The viscosity of the coating solution was measured prior to application onto the cigarette spills. The amount of solution on the cigarette spills was determined by weighing the spill before and after applying the solution. Approximately 100 mg of solution was hand painted on each cigarette spill. The amount of add-on was controlled by the concentration of solution instead of the amount of solution applied. The coated spills were air-dried and conditioned at 60 percent RH and 75° F. Approximately 630 mg of tobacco was blown into the spills.

The data for these experiments is set forth in Table III as follows:

TABLE III

| Sample | Solution Chemical Composition (%) | Solution Viscoscity (cps) | Puff # | SS Tar (mg) | % SS Reduction |
|---|---|---|---|---|---|
| | Control | | 9.2 | 24.1 | — |
| 25 | Amoloid LV(1)/$K_3$Cit(2)/M-365(3)[b] | 84 | 11.6 | 13.2 | 46 |
| 26 | Amoloid LV(1)/$K_3$Cit(2)/M-250(3) | 83 | 11.5 | 14.1 | 42 |
| 27 | Amoloid LV(1)/$K_3$Cit(2)— | 78 | 10.7 | 16.1 | 33 |
| 28 | Amoloid LV(1)/KS(2[a]/M-365(3) | 96 | 12.2 | 11.2 | 54 |
| 29 | Amoloid LV(1)/KS(2)/M-250(3) | 96 | 11.7 | 10.7 | 56 |
| 30 | Amoloid LV(1)/KS(2)/— | | 11.5 | 11.9 | 51 |
| 31 | Amoloid LV(1)/$K_3$Cit(1)/KS(1)/M-365(3) | 91 | 12.6 | 11.2 | 54 |
| 32 | Keigin XL(1.5)/KS(6) | 135 | 11.8 | 11.4 | 53 |
| 12 | Superloid (1.5)/KS(6) | 584 | 12.0 | 11.2 | 54 |
| 11 | Superloid (1)/KS(6) | 112 | 11.3 | 11.9 | 51 |

TABLE III-continued

| Sample | Solution Chemical Composition (%) | Solution Viscoscity (cps) | Puff # | SS Tar (mg) | % SS Reduction |
|---|---|---|---|---|---|
| 33 | Kelmar (1.5)/KS(6) | 967 | 10.2 | 12.6 | 48 |

[a]KS is potassium succinate prepared by reacting succinic acid with potassium hydroxide;
[b]Maltrin M-250 and M-365 are corn syrups having a dextrose equivalent of 25 and 37, respectively; and were obtained from Grain Processing Corporation.

Even though all alginates tested were found to be effective in reducing sidestream smoke, the results indicated that the effectiveness of alginates and burning additives for sidestream reduction are in the following order:

Ammonium Alginate>Sodium Alginate>Potassium Alginate

Potassium Succinate>Potassium Citrate>Sodium Citrate

The formulation of ammonium alginate (1 percent), potassium citrate (1 percent), potassium succinate (1 percent), and M-365 corn syrup (3 percent) achieved a reduced sidestream smoke of more than 50 percent compared to the control, increased the puff number by 2–3 puffs, and had a good ash appearance. The cigarettes made with the paper coated with alginates and potassium salts did not impart an off-taste on the mainstream smoke. The corn syrup additives M-250 and M-365 further enhanced the flavor of the smoke. The addition of Maltrin, especially M-365 to the cigarette paper improved the body and smoothness, and imparted some sweet taste to the cigarette.

EXAMPLE IV

In this example, film forming coatings were prepared using pectins.

The cigarette spills used for coating were prepared from chemical free paper having a basis weight of 47 g/m$^2$, a filler content of 28 percent by weight chalk, and a porosity of 5 to 6 Coresta units. The total length of the cigarettes was 99 mm wherein the tobacco section was 69 mm in length and the tipping was 36 mm in length. The circumference of the cigarettes was 24.7 mm.

The coating material consisted of BB Rapid Setting pectin obtained from Hercules Incorporated; M-365 corn syrup having a dextrose equivalent of 37; potassium succinate; and potassium citrate.

Solutions were prepared and the viscosities of the coating solutions were measured prior to application onto the cigarette spills. The amount of solution applied onto the cigarette spills was determined by weighing the spill before and after applying the solution. Approximately 100 mg of solution was brushed on the cigarette spills by hand. The amount of add-on was controlled by the concentration of solution instead of the amount of solution applied to the cigarette spill. The coated spills were air-dried and conditioned at 60 percent RH and 75° F. Approximately 630 mg of tobacco was blown into the spills.

The data obtained from the experiments is set forth in Table IV as follows:

TABLE IV

Pectin as a Film Formine Arent for Low Side Stream Paper

| Sample # | Solution Composition | Viscosity (cps) | Paper Permeability* | Puff # | SS Tar (mg) | % SS Reduction |
|---|---|---|---|---|---|---|
| 1. | 1% BB Rapid Setting Pectin** | 39 | 4.3 | 8.7 | 22.5 | 7% |
| 2. | 1% BB Rapid Setting Pectin/2% $K_3$ Cit | 29 | 4.0 | 7.2 | 19.8 | 18% |
| 3. | 1% BBRS/2% $K_3$ Cit/3% M-365 | 35 | 3.5 | 7.5 | 17.0 | 30% |
| 4. | 1% BBRS/2% $K_2$ Succ | 36 | 3.8 | 7.4 | 18.8 | 22% |
| 5. | 1% BBRS/2% $K_2$ Succ/3% M-365 | 39 | 3.3 | 7.3 | 17.8 | 26% |
| 6. | 2% BBRS/4% $K_3$ Cit | 28 | — | 5.7 | 16.8 | 30% |
| 7. | 2% BBRS/4% $K_2$ Cit/3% M-365 | 60 | — | 6.7 | 17.8 | 26% |
| 8. | 2% BBRS/4% $K_2$ Succ | 90 | — | 6.5 | 15.2 | 37% |
| 9. | 2% BBRS/4% $K_2$ Succ/3% M-365 | 86 | — | 6.6 | 17.5 | 27% |
| 10. | 2% BBRS/2% $K_3$ Cit/2% $K_2$ Suc/3% M-365 | 35 | — | 6.2 | 15.3 | 37% |

*Solutions were blushed on cigarette spills made ofeigarette paper (5.6 Coresta Unites, 28% Chalk, 47.1 g/m$^2$);
**BBRS is BB Rapid Setting pectin obtained from Hercules Incorporated, (Hercules e Gums);
M-365 is corn synip having a dextrose equivalent of 37;
KSuce is potassium succinate; and
$K_3$Cit is potassium citrate.

The cigarette wrapping paper incorporating the film forming pectin solution reduced the sidestream smoke, but was not as effective as the cigarette wrapping paper which incorporated the film forming alginate solution.

These film forming agents are believed to work by blocking some of the natural pores in paper which prevents some of the sidestream smoke from diffusing through the paper. Ammonium alginate, sodium alginate, and potassium alginate appear to act synergistically with the $CaCO_3$ filler in cigarette paper to form a gel coating. The ammonium alginate solution provides a greater sidestream reduction than a sodium carboxymethyl cellulose solution of approximately the same concentration and viscosity and cigarettes with ammonium alginate treated papers also provide a better taste than cigarettes with sodium carboxymethyl cellulose treated papers. The use of an ammonium alginate/potassium succinate treated paper provides a cigarette with significant sidestream reduction with good ash burning and sensory properties.

These sidestream reducing agents work on cigarette paper either alone or in conjunction with paper burning additives such as potassium citrate or succinate. Special paper fillers used in other reduced sidestream papers, such as magnesium oxide, aluminum oxide, or clays, are not required to achieve the desired sidestream smoke reducing properties. In addition to producing a reduced sidestream paper when applied to conventional types of cigarette paper, the additives of the present invention have been found to further improve the performance of commercially produced reduced sidestream papers.

It is realized that the foregoing is only for explanation purposes and it is also realized that other applications may be made within the scope and spirit of the present invention without limitations to the claims appended hereto.

What is claimed is:

1. A cigarette paper having a basic weight of from about 20 to 65 grams per square meter, and a porosity prior to adding additives of from about 5 to 50 Coresta units, said paper after adding additives comprising from about 0.3 to 4.0 percent by weight of an alginate film forming agent select from the group of ammonium alginate, sodium alginate, and potassium alginate, and from about 1 to 8 percent by weight of least one burn additive.

2. The cigarette wrapper of claim 1, wherein said burn additive is an alkali metal salt.

3. The cigarette wrapper of claim 2, wherein said alkali metal salt is an alkali metal carboxylate.

4. The cigarette wrapper of claim 3, wherein said alkali metal carboxylate is selected from the group consisting of potassium succinate, potassium citrate, potassium acetate, sodium succinate, sodium citrate, sodium acetate.

5. A cigarette wrapping paper having a surface treated with about 0.3 to 4.0 percent by total weight of an alginate film forming solution selected from the group of ammonium alginate, sodium alginate, and potassium alginate and at least one burn additive having a total weight of from about 1 to 8 percent.

6. The cigarette wrapping paper of claim 5, wherein said paper has a basis weight of from about 20 to 65 $g/m^2$ basic weight, and a porosity prior to surface treatment of from about 5 to 50 Coresta units.

7. The cigarette wrapper of claim 5, wherein said burn additive is an alkali metal salt.

8. The cigarette wrapper of claim 7, wherein said alkali metal salt is an alkali metal carboxylate.

9. The cigarette wrapper of claim 8, wherein said alkali metal carboxylate is selected from the group consisting of potassium succinate, potassium citrate, potassium acetate, sodium succinate, sodium citrate, sodium acetate.

* * * * *